US005375979A

United States Patent [19]

Trah

[11] Patent Number: 5,375,979

[45] Date of Patent: Dec. 27, 1994

[54] THERMAL MICROPUMP WITH VALUES FORMED FROM SILICON PLATES

[75] Inventor: Hans-Peter Trah, Reutlingen, Germany

[73] Assignee: Robert Bosch GmbH, Stuttgart, Germany

[21] Appl. No.: 78,132

[22] Filed: Jun. 16, 1993

[30] Foreign Application Priority Data

Jun. 19, 1992 [DE] Germany ..... 4220077

[51] Int. Cl.[5] ..... F04B 19/24

[52] U.S. Cl. ..... 417/52; 417/207

[58] Field of Search ..... 417/52, 207

[56] References Cited

U.S. PATENT DOCUMENTS

| | | | |
|---|---|---|---|
| 4,805,804 | 2/1989 | Raczkowski | 417/207 |
| 4,849,774 | 7/1989 | Endo et al. | 417/207 |

FOREIGN PATENT DOCUMENTS

| | | | |
|---|---|---|---|
| 859743 | 7/1949 | Germany | 417/52 |
| 802601 | 2/1981 | U.S.S.R. | 417/207 |
| 1229421 | 5/1986 | U.S.S.R. | 417/52 |
| 1498943 | 8/1989 | U.S.S.R. | 417/207 |
| 1571287 | 6/1990 | U.S.S.R. | 417/207 |

*Primary Examiner*—Richard A. Bertsch
*Assistant Examiner*—Roland G. McAndrews, Jr.
*Attorney, Agent, or Firm*—Kenyon & Kenyon

[57] ABSTRACT

In a micropump having a working chamber (1), an intake valve (2), and a discharge valve (3), the valves (2,3) are etched out of silicon wafers (4,5). The gas in the working chamber (1) is heated by a heating element (6), so that an overpressure is produced in the working chamber. A partial vacuum is created by cooling the gas in the working chamber (1). The pump action of the micropump is achieved through the succession of overpressure and partial-vacuum cycles.

11 Claims, 2 Drawing Sheets

THERMAL MICROPUMP WITH VALUES FORMED FROM SILICON PLATES

FIELD OF THE INVENTION

The present invention relates to a pump and in particular to a micropump having a chamber, an intake valve, and a discharge valve.

BACKGROUND OF THE INVENTION

A publication by Zengerle, MEMS 1992, Travemunde, *IEEE Catalog No.* 92*CH*3093-2, pp. 19–24, describes a micropump having a working chamber, one intake valve, and one discharge valve that are structured as silicon wafers. The pump action is achieved by an electrostatically produced change in the volume of the working chamber. This valve is particularly suited for liquids.

SUMMARY OF THE INVENTION

The present invention provides a device and method for pumping a gas or fluid. A micropump according to the present invention has a first plate having a chamber disposed therein. The first plate includes an intake valve at a first portion of the chamber for movement between a first position at which the gas flows into the chamber and a second position spaced from the first position. The micropump also has a second plate coupled to the first plate. The second plate includes a discharge valve at a second portion of the chamber for movement between a third position at which the gas flows out of the chamber and a fourth position spaced from the third position. Further, the micropump includes a heating element at a third portion of the chamber for controlling a temperature of the gas in the chamber.

The present invention includes a method for operating the micropump. Accordingly, the present invention includes a method for pumping a gas (or fluid) by the steps of (a) increasing the temperature of a heating element to increase the pressure of the gas inside the chamber and to open a discharge valve of the chamber, which causes the gas to flow out of the chamber until the discharge valve closes, (b) upon closing of the discharge valve, decreasing the temperature of the heating element to decrease the pressure of the gas inside the chamber and to open an intake valve of the chamber, which causes the gas to flow into the chamber until the intake valve closes, and (c) repeating steps (a) and (b) until a predetermined volume of the gas is pumped.

An advantage of the micropump according to the present invention is that the applied pump principle allows gases to be pumped effectively. The micropump is small in size and suited for producing pressures of a few hundred millibars. Also considered as advantageous are the relatively low power consumption and the relatively fast time constant of the micropump according to the present invention.

A heating element is designed quite simply as an ohmic resistor. The power dissipation is reduced and the reaction rate of the micropump is improved by mounting the heating element on a carrier having a low thermal capacity and low thermal conductivity. The carrier can be composed of a material having a low thermal conductivity, or the thermal capacity and the thermal conductivity of the carrier can be reduced by constructing the carrier as a thin membrane. A support is used to stabilize the carrier, which increases the mechanical stability of the micropump. In particular, the support suppresses any change in the volume of the working chamber caused by pressure. By forming the supporting structures out of silicon, such supporting structure can be produced without incurring significant additional expenses. In the case of a pulse-shaped heating operation, the amount of gas delivered can be advantageously controlled by controlling the temperature and/or the time interval between the heating pulses.

DETAILED DESCRIPTION

Figure 1:
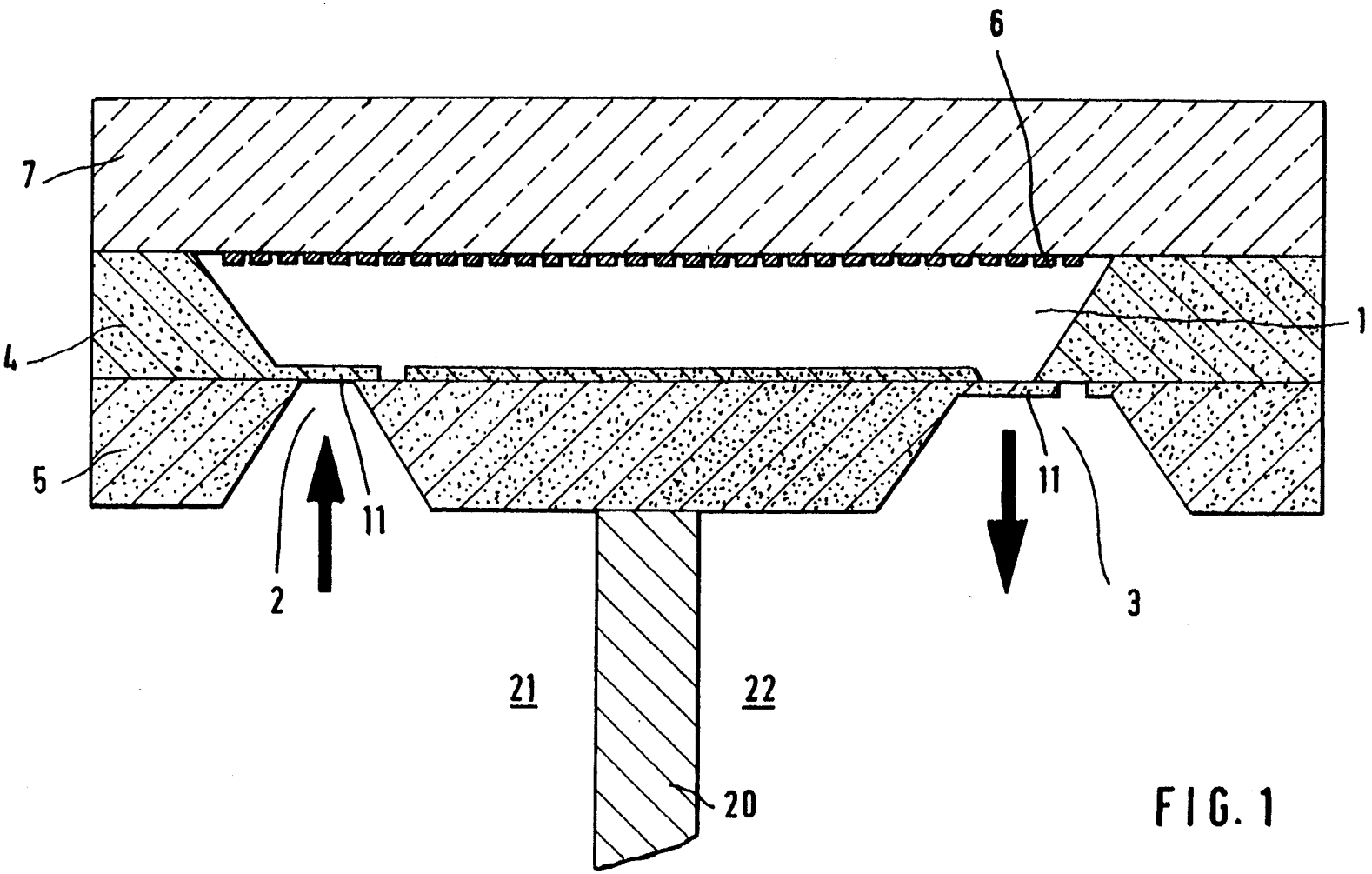
FIG. 1 shows a first exemplary embodiment of the micropump according to the present invention.

Referring to FIG. 1, formed out of two silicon plates 4, 5 are one intake valve 2 and one discharge valve 3, which open to volumes 21 and 22, respectively, separated by a wall 20. The working chamber 1 is created from a cut-out in the silicon plate 4 and is sealed on its top side by the plate-shaped carrier 7 of the heating element 6.

The intake valve 2 is designed to open when the pressure prevailing in the working chamber 1 is less than that on the outside. The discharge valve 3 is designed to open when the pressure prevailing in the working chamber 1 is greater than that on the outside. Both valves are designed to open even at low pressure differences. The air in the working chamber 1 is heated by means of the heating element 6. The heating element 6 can consist of, for example, deposited metallic layers that are heated by a current flowing through them. FIG. 1 shows a cross-section through such metallic printed conductors, which are applied on the carrier 7 in a meander form or as spirals. The gas trapped in the working chamber 1 is heated by the heating element 6. The heating effect of the heating element 6 increases as the heat lost through the carrier 7 or the silicon plates 4, 5 decreases. Therefore, in the exemplary embodiment of FIG. 1, the carrier 7 is composed of glass that has an especially low thermal conductivity. Such glass is known, for example, by the commercial name, Pyrex, from the firm, Corning Glass.

The micropump according to the present invention works on the basis of the thermal expansion of gases. In the first step of a pump cycle, the micropump is in the state depicted in FIG. 1. Both valves are closed and the gas inside of the working chamber 1 has essentially the same temperature as the gas outside of the working chamber 1. The heating element 6 is then heated by a current, so that the gas in the working chamber 1 is heated. Based upon the ideal gas equation, which applies here in a first approximation, the product of pressure and volume (i.e., pressure x volume) in the working chamber 1 is constant in relation to the temperature of the gas in the working chamber 1. Since the volume of the working chamber 1 does not change, a pressure increase in the working chamber 1 is caused by the heating of the gas in the working chamber 1. As a result of this pressure increase, the discharge valve 3 opens and a portion of the gas in the working chamber 1 is forced out of the working chamber 1 into volume 22.

Thereafter, when an equilibrium is attained between pressure and temperature, the discharge valve 3 closes.

In the next cycle step, the heating of the heating element 6 is switched off. This is associated with a cooling of the gas that is present in the working chamber 1. Associated with this cooling of the gas is a decrease in the pressure prevailing in the working chamber 1. As a result of the diminished pressure in the working chamber 1, the intake valve 2 opens, and gas flows into the working chamber 1 from volume 21 until this difference in pressure is equalized, at which time the intake valve 2 closes again. The micropump again enters the state shown in FIG. 1, and a new pump cycle can begin. Thus, the micropump pumps gas from volume 21 into volume 22. By having appropriate supply lines leading to volumes 21, 22, the micropump can be used to pump gases in any desired manner.

To manufacture the valves, silicon plates 4, 5 are worked on from both sides using etching processes. Thin membranes are produced in the etching process, starting from the one side of the silicon plates 4, 5. By dividing these thin membranes in an etching process from the other side, the intake opening of the intake valve 2 and the valve flap 11 of the discharge valve 3 are constructed out of the silicon plate 5. In the same way, the valve flap 11 for the intake valve 2, the cut-out for the working chamber 1, and the opening for the discharge valve 3 are constructed out of the silicon plate 4. The two silicon plates 4, 5 and the carrier 7 are joined together so as to form the working chamber 1, which is sealed in a gas-tight manner. European No. EP-A1-369 352, for example, describes methods for joining the silicon plates 4, 5 and the carrier 7, and methods for establishing an electrical contact with the heating elements 6.

Figure 3:
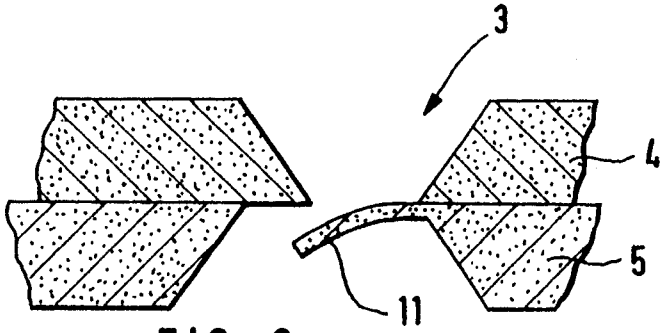
FIG. 3 shows the discharge valve of the micropump of FIG. 1 in an open position.
Figure 2:
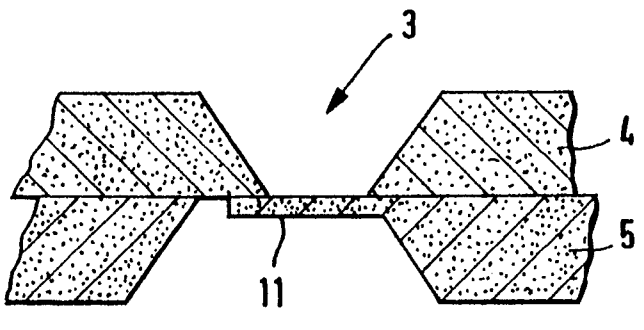
FIG. 2 shows the discharge valve of the micropump of FIG. 1 in a closed position.

In FIGS. 2 and 3, the discharge valve 3 of FIG. 1 is shown in an enlarged view. This discharge valve 3 is structured out of the silicon plates 4, 5. For this purpose, each of the silicon plates 4, 5 has an opening. However, in FIG. 2, this opening is sealed by the valve flap 11. In FIG. 2, the discharge valve is shown in the state in which the pressure in the working chamber is less than or equal to the outside pressure. In this case, the valve flap 11 is closed. In FIG. 3, the discharge valve 3 is shown in a state in which a higher pressure prevails inside the working chamber 1 than outside the micropump. In this case, the discharge valve 3 is open, i.e., the valve flap 11 is bent in a way that allows air to flow out of the working chamber 1. The intake valve 2 functions in an analogous fashion.

Figure 4:
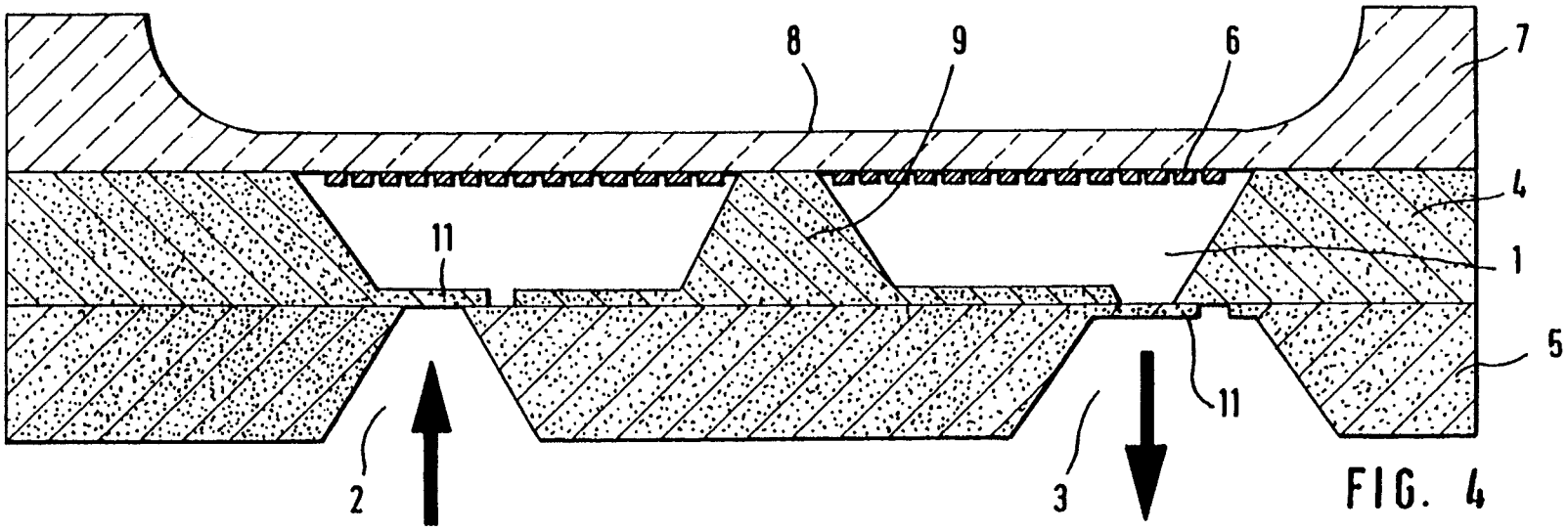
FIG. 4 shows a second exemplary embodiment of the micropump according to the present invention.

FIG. 4 illustrates another exemplary embodiment of the micropump according to the present invention. This embodiment likewise has an intake valve 2, a discharge valve 3 and a working chamber 1 that are etched out of silicon plates 4, 5. On its top side, the working chamber 1 is sealed off by a carrier 7, and a heating element 6 is mounted on the carrier 7. However, in contrast to FIG. 1, the carrier 7 is diminished in its thickness in the vicinity of the heating element 6. As a result of this reduction in the thickness of the carrier 7, the thermal conductivity and the thermal capacity of the carrier 7 are reduced. Thus, with this refinement of the carrier 7, the heating capacity of the heating element 6 is improved. In this manner, with lower electric power, this heating element reaches the same temperature as the heating element shown in FIG. 1. Furthermore, with this measure, the time required to heat the heating element 6 is reduced and, consequently, the heating of the gas in the working chamber 1 is likewise accelerated. In comparison with the micropump shown in FIG. 1, the micropump shown in FIG. 4 provides a lower power consumption and a faster reaction.

Care must be taken, however, that the membrane 8 on which the heating element 6 is mounted is not at all, or is only slightly, deformed by the pressure difference produced in the working chamber 1. Otherwise, the pump capacity would again be reduced as a result of too great a deformation of the membrane 8. Therefore, the membrane 8 must be designed to be thick enough. Furthermore, the membrane 8 can be stabilized by one or more supports 9, with FIG. 4 illustrating the use of a single support 9. The support 9 can be structured out of the silicon plate 4. The advantage of this is that the manufacturing of the support 9 does not require any additional process steps. In the cross-sectional view of the micropump shown in FIG. 4, a cross-section through the support 9 is illustrated. The areas of the working chamber 1 situated in FIG. 4 to the right and left of the support 9 are joined with one another, however, so that gas can flow unhindered from the intake valve 2 to the discharge valve 3.

The pump capacity, i.e., the flow rate produced through the micropump, can be controlled in different ways. One such way is by controlling the temperature of the heating element 6. In every pump cycle, the quantity of pumped air depends on the temperature of the heating element 6. The pump capacity is increased by raising the temperature of the heating element 6. It is also feasible to control the flow rate through the micropump by altering the time intervals of the individual pump cycles. The pump capacity can likewise be controlled by shortening the time between the individual pump cycles.

What is claimed is:

1. A micropump comprising:

a first plate constructed of silicon forming a first part of a chamber;

a second plate constructed of silicon forming a second part of the chamber and coupled to the first plate;

the chamber including an intake valve at a first location of the chamber for movement between a first position for allowing fluid to flow into the chamber and a second position for preventing fluid from flowing into the chamber;

the chamber further including a discharge valve at a second location of the chamber for movement between a third position for allowing fluid to flow out of the chamber and a fourth position for preventing fluid from flowing out of the chamber; and a heating element member forming a third part of the chamber for controlling a temperature of fluid in the chamber, the heating element member including a carrier and a heating element;

wherein the intake and discharge valves are formed out of the first and second plates, and wherein the carrier is coupled to the first plate, with the carrier supporting the heating element at a first surface of the carrier and having a lower thermal capacity and a lower thermal conductivity at the first surface of the carrier than at a remainder of the carrier.

2. The micropump according to claim 1, wherein the intake valve moves between the first and second positions and the discharge valve moves between the third and fourth positions as a function of a pressure difference between a pressure of gas inside of the chamber and a pressure of gas outside of the chamber.

3. The micropump according to claim 1, wherein the intake valve and the discharge valve are etched out of the first and second plates.

4. The micropump according to claim 1, wherein the heating element includes an ohmic resistor.

5. The micropump according to claim 1, wherein the carrier has a lower thickness at the first surface than at the remainder of the carrier.

6. The micropump according to claim 1, wherein the carrier is constructed of a material having a thermal conductivity lower than a preselected value.

7. The micropump according to claim 1, wherein the micropump further comprises support means for stabilizing the carrier.

8. The micropump according to claim 2, wherein the support means is made from silicon, and is coupled to the first surface of the carrier.

9. The micropump according to claim 1, wherein the heating element member is heated by means electrical pulses.

10. The micropump according to claim 9, wherein the heating element member temperature controls a rate at which fluid is pumped.

11. The micropump according to claim 9, wherein a time interval between the electrical pulses controls a rate at which fluid is pumped.

* * * * *

UNITED STATES PATENT AND TRADEMARK OFFICE

CERTIFICATE OF CORRECTION

PATENT NO. : 5,375,979

DATED : December 27, 1994

INVENTOR(S) : Hans-Peter Trah

It is certified that error appears in the above-indentified patent and that said Letters Patent is hereby corrected as shown below:

Title page, item [54] and col. 2, in the title "VALUES" should be --VALVES
Column 6, line 4, "claim 2" should be --claim 7--.

Signed and Sealed this

Twenty-sixth Day of September, 1995

*Attest:*

Bruce Lehman

BRUCE LEHMAN

*Attesting Officer*

*Commissioner of Patents and Trademarks*